US005506876A

United States Patent [19]

Homer

[11] Patent Number: 5,506,876

[45] Date of Patent: Apr. 9, 1996

[54] COUNTING AND MARKING DEVICE

[76] Inventor: John W. Homer, 108 Forest La., Cheshire, Conn. 06410

[21] Appl. No.: 494,805

[22] Filed: Jun. 26, 1995

[51] Int. Cl.[6] ..... G06M 3/06; G06M 11/00

[52] U.S. Cl. ..... 377/15; 377/112

[58] Field of Search ..... 377/15, 112

[56] References Cited

U.S. PATENT DOCUMENTS

| | | | |
|---|---|---|---|
| 3,625,226 | 12/1971 | Flesselles | 377/15 |
| 4,048,478 | 9/1977 | Miwa | 377/15 |
| 4,295,038 | 10/1981 | Kreinbrink et al. | 377/6 |
| 4,532,642 | 7/1985 | Morris et al. | 377/15 |
| 4,726,044 | 2/1988 | Perna et al. | 377/15 |
| 4,993,050 | 2/1991 | Carpenteri et al. | 377/15 |
| 5,105,448 | 4/1992 | Kashiwabara | 377/15 |

*Primary Examiner*—John S. Heyman
*Attorney, Agent, or Firm*—Norman B. Rainer

[57] ABSTRACT

A device for reliably counting and simultaneously marking objects includes a tubular sleeve slidably emergent from a housing that contains an electronic counter and electromagnet. A marking tip and ink reservoir are slidably held within the sleeve and are forwardly urged by a spring. Whenever the sleeve is pressed against an object, the electromagnet drives the marking tip forwardly to mark the object and, simultaneously, electrical contacts interactive between the sleeve and housing register one count on the counter.

8 Claims, 2 Drawing Sheets

COUNTING AND MARKING DEVICE

BACKGROUND OF THE INVENTION

1. Field of the Invention

This invention concerns the counting of items and simultaneous marking of said items during counting, and further relates to apparatus for accurately achieving said simultaneous counting and marking.

2. Description of the Prior Art

In the course of conducting business activities, it is often necessary to take an inventory of items in storage as on shelves or in bins, racks or other storage systems. The counting of items of similar or identical appearance can be a tedious chore and subject to considerable error, particularly if the items are subject to movement in the course of the counting operation.

To enhance the accuracy of counting, one technique involves the marking of an item at the instant that it is being counted. Devices for the simultaneous marking and counting of items have earlier been disclosed, as for example in the following U.S. Patents:

U.S. Pat. No. 4,993,050 to Carpenteri, et. al., discloses a counter/marker apparatus comprising a head assembly counter mechanism and attached first elongated sleeve. A second sleeve, portioned within said first sleeve for axially slidable reciprocal motion therein, is adapted to carry a marking pen. Relative movement between said sleeves causes activation of a switch which registers one unit of count upon said counter mechanism. A restoring spring urges the tip of the marking pen forwardly.

Although the Carpenteri, et. al., apparatus is based upon sound general concepts, one of its shortcomings is that, as indicated at column 2, lines 50–53, the tip of the marking pen must be displaced rearwardly by at least ⅛ inch to activate the switch. The problem is that, if the pen is not displaced rearwardly by at least ⅛ inch, a mark will be made on an item, but no count will be made. It is also possible that, if the travel of the pen is not a pure reciprocal harmonic motion, as a result of a pause or axially transverse wiggle, more than one count may be registered with a single marking.

U.S. Pat. No. 4,726,044 to Perna, et. al., discloses a counter/marker device in the form of a ball point pen having a movable ball point that is passed upwardly in the direction of the housing of the pen when a mark is made. Such upward movement closes a switch which activates an electronic counter. A second switch, activated by gravity, resets the counter for counting the next mark. The Perna, et.al., device will only function in marking substrates that are downwardly disposed. Also, there is no assurance that the counter is activated even though a mark has been made.

U.S. Pat. No. 4,048,478 to Miwa, et. al., concerns a pen-shaped marking apparatus with electronic counter. The apparatus utilizes a single push button type of switch to activate the counter.

U.S. Pat. No. 4,295,038 to Kreinbrink, et. al., discloses a pen-shaped marker connected by an electrical conductor to an otherwise separate counter device. As in the foregoing devices, there is no fail-safe provision to assure that, for each mark, there is a single count.

U.S. Pat. No. 4,532,642 to Morris, et.al., discloses a counting stamper apparatus. A switch, mounted in the handle of the apparatus, is contacted by the upwardly directed stamping element to activate an electronic counting circuit.

It is accordingly an object of the present invention to provide a marking and counting device which will infallibly register a single count for each mark.

It is a further object of this invention to provide a device as in the foregoing object which can be employed in any attitude of use.

It is another object of the present invention to provide a device of the aforesaid nature which is of compact construction and easy to use.

These objects and other objects and advantages of the invention will be apparent from the following description.

SUMMARY OF THE INVENTION

The above and other beneficial objects and advantages are accomplished in accordance with the present invention by a counting and marking device comprising:

a) an elongated housing having forward and rearward extremities, b) a tubular sleeve slidably emergent from said forward extremity in coextensive alignment with said housing, said sleeve terminating in a distal extremity disposed forwardly of said housing, and having a proximal extremity disposed within said housing, c) electronic means for counting and control, located within said housing, d) electromagnet means comprised of a stationary core positioned within said housing adjacent said forward extremity and provided with a winding of electrical conductor wire, and a plunger rod reciprocatively interactive with said core and having front and rear ends, e) retaining means affixed to said sleeve adjacent said proximal extremity and slidably held within said housing, f) a restoring spring which urges said retaining means and associated sleeve forwardly, g) a marking tip slidably disposed within said sleeve adjacent said distal extremity, h) a tubular ink reservoir disposed within said sleeve and having a first extremity that attaches to said tip, and a second extremity that protrudes rearwardly from the proximal extremity of said sleeve, i) a retaining spring which urges said reservoir rearwardly, and j) switch means for activating said electronic means, said switch means being in an off condition while said sleeve is at a forward-most position under the urging of said restoring spring, and is in an on condition when said sleeve is forced rearwardly against the urging of said restoring spring, whereby the on condition of said switch causes: 1) said plunger to act upon the second extremity of said reservoir to drive said tip forwardly to mark an object which said sleeve is pressed against, and 2) said electronic means to register a count.

The housing also holds batteries for energizing the electronic and electromagnet means. Display means in the form of digital L.C.D. units are mounted upon the exterior surface of the housing. Such display means may show not only the count number but other information derivable from a small electronic computer.

The device may further be provided with a forwardly projected light source to aid in viewing the objects which are being counted, and an audio/visual mechanism which will produce a sound and light signal each time an object is marked and properly counted.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
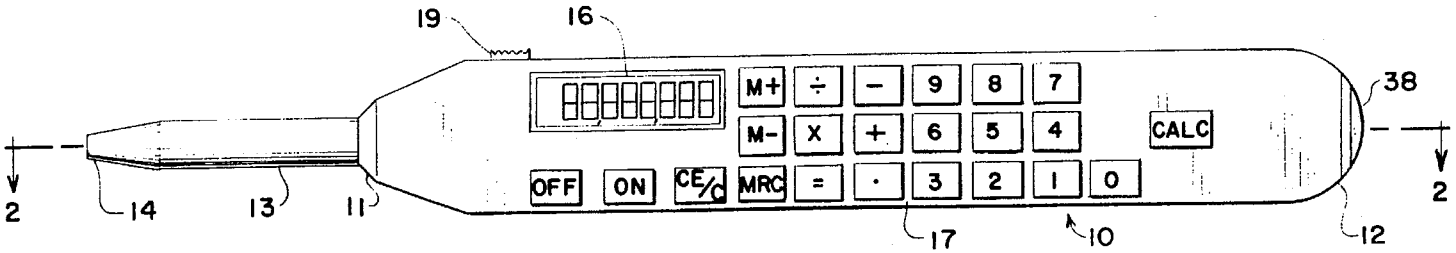
FIG. 1 is a side view of an embodiment of the device of the present invention.
Figure 2:
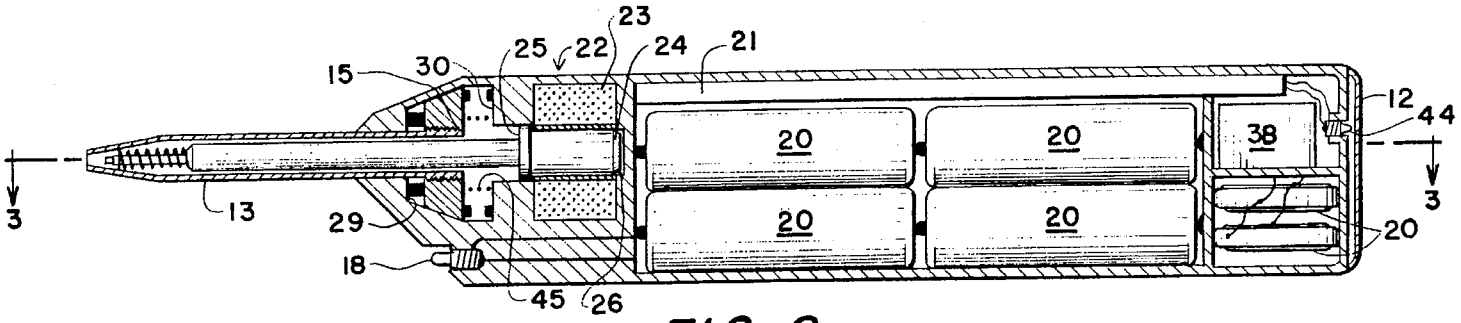
FIG. 2 is a sectional view taken in the direction of the arrows upon the line 2—2 of FIG. 1.
Figure 3:
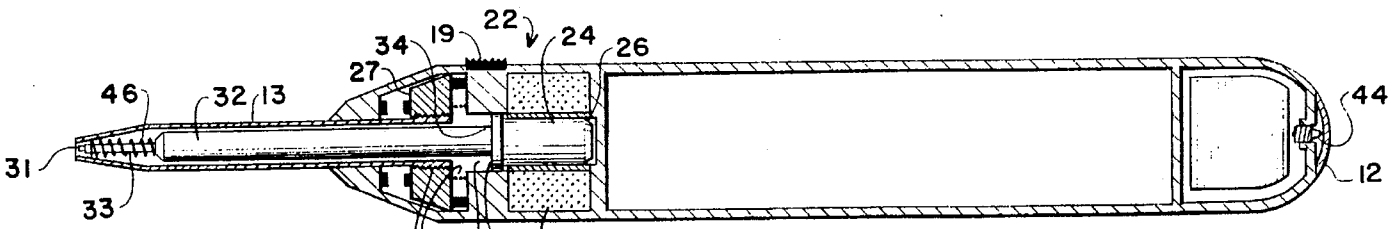
FIG. 3 is a sectional view taken in the direction of the arrows upon the line 3—3 of FIG. 2.

Referring to FIGS. 1–3, an embodiment of the device of the present invention is shown comprised of elongated housing 10 having forward and rearward extremities 11 and 12, respectively, and tubular sleeve 13 emergent from said forward extremity in coextensive alignment with said housing. Sleeve 13 terminates in a distal extremity 14 disposed forwardly of housing 10, and an opposite proximal extremity 15, disposed within said housing.

Positioned upon the exterior surface of housing 10 are liquid crystal diode display window 16, a computer keyboard 17, a forwardly projecting viewing light 18, and on/off button 19. A removable panel is associated with the housing to facilitate insertion of batteries 20 into housing 10. Noise-generating means 38 which may be in the form of a horn, buzzer or bell, and light signaling means 44 may be associated with rearward extremity 12.

Electronic means 21 for counting, control and computational functions is located within said housing beneath said display window 16 and keyboard 17. The electronic means is of known construction, and may typically be the same electronic means as disclosed in the aforesaid U.S. Pat. Nos. 4,993,050; 4,726,044; 4,048,478; and 4,295,038.

Electromagnet means 22 may be comprised of a stationary core 23 positioned within said housing adjacent said forward extremity and provided with a winding of electrical conductor wire, and a plunger rod 24 adapted to enter said core in a reciprocating manner. Plunger rod 24 extends to front and rear ends 25 and 26, respectively. In an alternative embodiment of the electromagnet means, the plunger rod may be a forwardly protruding feature of a yoke that embraces core 23.

Retaining means in the form of collar 27 is secured to sleeve 13 adjacent proximal extremity 15 and forwardly of core 23. Said securement is exemplified by a region of threading 35. Although other means may be employed for securing collar 27 to sleeve 13, a threaded engagement is preferred for reasons of adjustability and to facilitate the changing of an ink reservoir and marking tip. Said collar is slidably retained by confining means in the form of chamber 28 within housing 10 and defined by forward and rearward abutment walls 29 and 30 respectively. A restoring coil spring 45 is interactive between collar 27 and wall 30 to urge said collar and associated sleeve forwardly.

A marking tip 31 is slidably disposed within sleeve 13 in attachment with tubular ink reservoir 32. Tip 31, which may be a felt marker tip, is positioned closely adjacent distal extremity 14. Reservoir 32 extends between a first extremity 33 that attaches to said tip, and a second extremity 34 that protrudes rearwardly from the proximal extremity of said sleeve. A retaining coil spring 46 acts against said sleeve to urge rearwardly the marking tip and attached reservoir.

First switch means are provided in the form of stationary contacts 36 on rearward abutment wall 30 and moving contacts 37 on the rear face of collar 27. Second switch means are provided in the form of stationary contacts 41 on forward abutment wall 29 and moving contacts 42 on the forward face of collar 27. Both switch means are in the off or non-circuit state when the contacts are separated. When sleeve 13 is forced rearwardly, contacts 36 and 37 meet, causing completion of an electrical circuit which involves said electronic means, batteries, electromagnet means, noise generator 38 and signal light 44. Similarly, when sleeve 13 is at its forwardmost point of travel, it activates said second switch means.

Figure 4A:
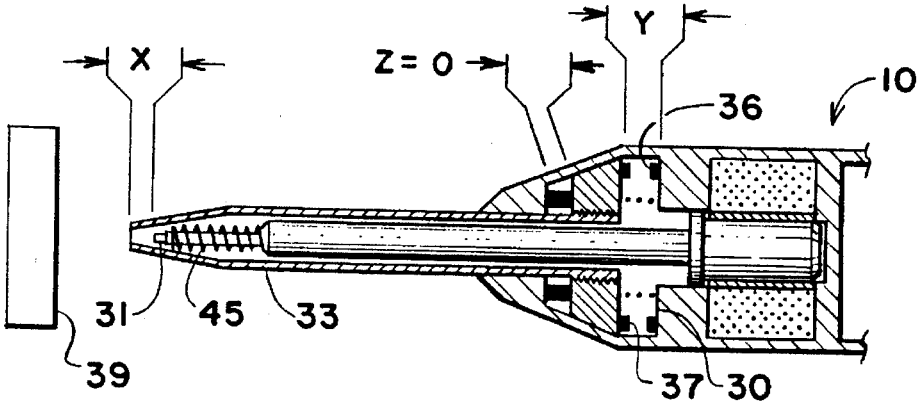
FIG. 4*a* is a fragmentary side schematic view of the embodiment of FIG. 1 illustrating the juxtaposition of components prior to use in a counting and marking step.
Figure 4B:
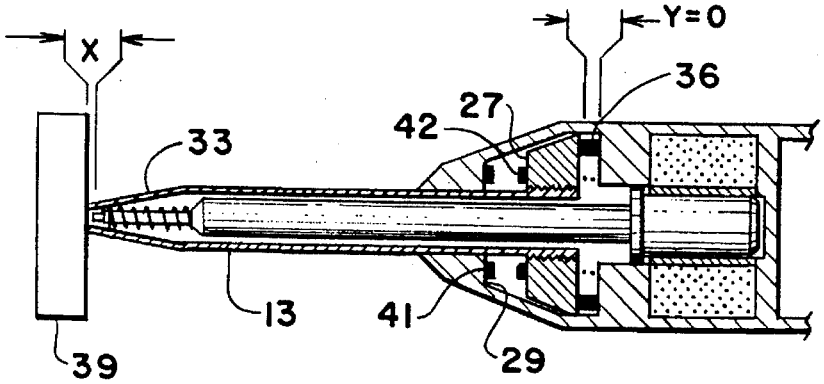
FIG. 4*b* is a view similar to FIG. 4*a* showing the status of components upon initiation of a counting and marking step.
Figure 4C:
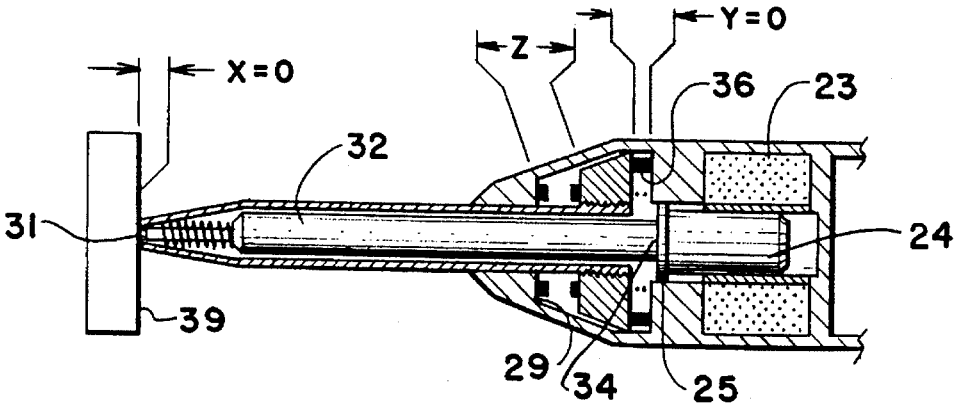
FIG. 4*c* is a view similar to FIG. 4*a* showing the status of components at the instant of simultaneous counting and marking of an object.

The operation of the device is illustrated in FIGS. 4*a* through 4*c*. In the starting state of the device, before contacting an object 39 to be marked and counted, sleeve 13 is in the forward-most position, as shown in FIG. 4*a*. In this position, there is a distance, designated by the symbol X, between the forwardmost extremities of sleeve 13 and tip 31. At the same time, there is a distance of separation, designated by the symbol Y, between opposing contacts 36 and 37 of said first switch means, and a distance of separation Z, now zero, between the contacts of said second switch means.

When object 39 is initially contacted by sleeve 13, as shown in FIG. 4*b*, and the device is pushed against said object, sleeve 13 is forced rearwardly, causing diminution of distances X and Y, and increase of distance Z.

At the maximum extent of forced contact of the device with object 39, sleeve 13 is forced rearwardly to its limit, causing distance Y to become zero, and causing the contacts of said first switch means to complete an electrical circuit. The completion of said circuit activates plunger rod 24 to push against second extremity 34 of said ink reservoir, thereby forcing tip 31 to mark the object while distance X becomes zero. At the same instant, a count is registered on the electronic counter, buzzer 38 sounds, and signal light 44 flashes to indicate successful completion of one marking and counting cycle. The electronic counter does not become ready to initiate another count or send another signal to the electromagnet until pressure is removed from said sleeve as detected by activation of said second switch (Z=0), an action which causes sleeve 13 to return to its forwardmost, starting position. Such functionality takes into account the fact that, if the pressure is not completely removed from the tip, the device may be fooled into generating multiple counts and/or marks for only one count and mark.

Accordingly, by virtue of the aforesaid arrangement of components, the device infallibly produces one mark for each count.

Marking means other than marking tip 31 may be employed. Equivalent alternative marking means include a miniature spray device or an ink jet device. Force applying means other than the exemplified electromagnet may be utilized to advance the ink reservoir and marking tip. Suitable alternative force-applying devices include: electric motors, levering systems, pneumatic and hydraulic cylinders and piezo-electric systems. Switching means other than the exemplified contact-type switches may be employed, other suitable position control means include proximity devices, electrostatic, and capacitative and optical sensors. Although exemplified as being battery operated, other power sources such as conventional AC current may power the apparatus.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A device for counting and marking objects comprising:

a) an elongated housing having forward and rearward extremities, b) a tubular sleeve slidably emergent from said forward extremity in coextensive alignment with said housing, said sleeve terminating in a distal extremity disposed forwardly of said housing, and having a proximal extremity disposed within said housing, c) electronic means for counting and control, located within said housing, d) electromagnet means comprised of a stationary core positioned within said housing adjacent said forward extremity and provided with a winding of electrical conductor wire, and a plunger rod reciprocatively interactive with said core and having front and rear ends, e) retaining means affixed to said sleeve adjacent said proximal extremity and slidably held within said housing, f) a restoring spring which urges said retaining means and associated sleeve forwardly, g) a marking tip slidably disposed within said sleeve adjacent said distal extremity, h) a tubular ink reservoir disposed within said sleeve and having a first extremity that attaches to said tip, and a second extremity that protrudes rearwardly from the proximal extremity of said sleeve, i) a retaining spring which urges said reservoir/tip rearwardly, and j) switch means for activating said electronic means and said electromagnet means, said switch means being in an off condition while said sleeve is at a forward-most position under the urging of said restoring spring, and is in an on condition when said sleeve is forced rearwardly upon contact with an object against the urging of said restoring spring, whereby the on condition of said switch causes: 1) said plunger rod in said electromagnet means to act upon the second extremity of said reservoir to drive said reservoir/tip assembly tip forwardly to mark said object with said tip, and 2) said electronic means to register a count.

2. The device of claim 1 wherein said housing holds batteries for energizing said electronic and electromagnet means.

3. The device of claim 2 further having a digital L.C.D. unit mounted upon said housing and interactive with said electronic means.

4. The device of claim 3 further provided with a forwardly projecting light source to aid in viewing objects which are being counted.

5. The device of claim 3 further provided with audio/visual means which produce sound and light signals each time an object is marked and properly counted.

6. The device of claim 3 wherein said retaining means comprises a collar attached to the proximal extremity of said sleeve and having opposed forward and rear faces, and a chamber that slidably confines said collar, said chamber having opposed forward and rearward abutment walls.

7. The device of claim 6 wherein said switch means is comprised of first switch means in the form of a stationary contact on said rearward abutment wall and an interactive moving contact on the rear face of said collar.

8. The device of claim 7 wherein said switch means is further comprised of second switch means comprising a stationary contact on said forward abutment wall and interactive moving contact on the forward face of said collar.

* * * * *